United States Patent [19]

Torvund et al.

[11] 3,994,481

[45] Nov. 30, 1976

[54] TAPPING CARRIAGE

[75] Inventors: Hermann Torvund, Ovre Ardal; Öistein Smith Larsen, Larvik, both of Norway

[73] Assignee: A/S Ardal OG Sunndal Verk, Oslo, Norway

[22] Filed: Dec. 26, 1974

[21] Appl. No.: 531,285

[52] U.S. Cl. ..... 266/239; 266/276; 204/245

[51] Int. Cl.[2] ..... C21C 5/42

[58] Field of Search ..... 13/33; 204/67, 245; 266/236, 239, 276, 38

[56] References Cited

UNITED STATES PATENTS

| | | | |
|---|---|---|---|
| 3,567,206 | 3/1971 | Heggstad et al. | 266/38 |
| 3,616,440 | 10/1971 | Forberg et al. | 204/245 |

*Primary Examiner*—Roy Lake
*Assistant Examiner*—Paul A. Bell
*Attorney, Agent, or Firm*—Wenderoth, Lind & Ponack

[57] ABSTRACT

A carriage with a crucible for tapping molten metal from aluminum electrolyzers and the like includes a movable tapping tube adapted to be inserted downwardly into the metal melt from which tapping shall take place, ejector means for sucking molten metal through the tapping tube, and a discharge tube for delivering collected metal from the crucible. There may also be provided compressed air means for discharging collected metal through the discharge tube. The tapping tube is mounted pivotably substantially in an inclined plane parallel to the longitudinal axis of the carriage and extending downwardly and outwardly to the side of the carriage from a tapping opening in a tapping head located on the crucible, to which tapping head the upper end of the tapping tube is coupled in the tapping position. The tapping tube is movable under control from the operator compartment on the carriage by means of power actuator means such as a hydraulic or pneumatic cylinder or the like, whereby the lower end of the tapping tube can be directed downwardly into the metal melt of the electrolyzer at the same time as the carriage is driven to the correct position at the electrolyzer for the tapping thereof.

12 Claims, 5 Drawing Figures

TAPPING CARRIAGE

BACKGROUND OF THE INVENTION

This invention relates to a carriage with a crucible for tapping molten metal from aluminum electrolyzers and the like, and including a movable tapping tube adapted to be inserted into the metal melt from which tapping shall take place, ejector means for sucking molten metal through the tapping tube, a discharge tube for delivering collected metal from the crucible and possible compressed air means for discharging collected metal through the discharge tube.

A previously commonly used method for bringing the movable tapping tube down into the melt for sucking up the same into the crucible and to couple the tapping tube to the crucible, has involved manual movement of the tapping tube which has constituted a separate unit in relation to the tapping tube and the crucible thereon. It is self-evident that such manual handling of this tapping tube has many disadvantages. One of the most important considerations is the risk or danger because of the high temperatures which occur, not only in the melt to be collected from the electrolyzer, but also in the tapping tube itself and other members in the structures employed, as a consequence of the heat influence from the melt.

Another method which has been proposed for mechanizing the tapping process has been based on suspension of the crucible in a crane, the crucible having in such case been provided with a fixed tapping tube which together with the whole crucible is directed to the desired position for tapping. This method, however, involves disadvantages, in the first place because of the fact that expensive crane equipment is occupied unnecessarily, and in the second place because the exact insertion of the tapping tube through a hole in the crust on the electrolyzer is very difficult by means of those cranes which are usually available.

SUMMARY OF THE INVENTION

Thus, it is an object of this invention to provide a tapping carriage for the above purpose and having improved means for effecting and controlling the movement of the tapping tube during the insertion thereof into the metal melt from which sucking or collecting shall take place.

What is novel and specific in the tapping carriage according to the invention primarily consists therein that the tapping tube is mounted pivotable in an inclined plane which is parallel to the longitudinal axis of the carriage and which extends downwardly and outwardly to the side of the carriage from a tapping opening in a tapping head provided on the crucible, to which tapping head the upper end of the tapping tube is coupled in the tapping position, and that the tapping tube is movable under control from the operator's seat on the carriage by means of a power actuator means, whereby the lower end of the tapping tube can be inserted downwardly into the metal melt of the electrolyzer at the same time as the carriage is driven to the correct position at the electrolyzer for the tapping thereof.

With an arrangement as stated above the tapping carriage according to the invention can very comfortably and securely as well as quickly be brought into position at an electrolyzer for the tapping thereof simultaneously with the insertion of the end of the tapping tube downwardly into the metal melt through a possible crust hole without problems with respect to the exact insertion or security. In addition thereto there is the very important advantage that the carriage operator will generally be able to attend to the complete tapping process alone, whereby a saving in labour can be obtained.

BRIEF DESCRIPTION OF THE DRAWINGS

The invention as well as additional features and advantages thereof will be more fully explained in the following description referring to the drawings, in which.

DETAILED DESCRIPTION OF THE INVENTION

Figure 1:
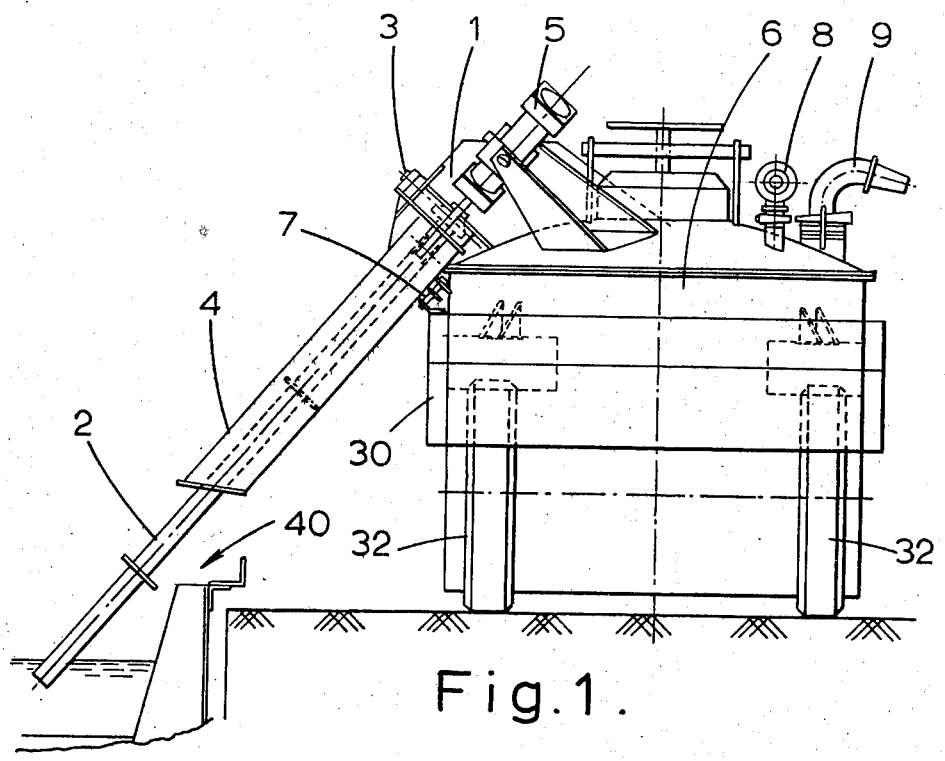
FIG. 1 is a rear view of a tapping carriage according to the invention, in position alongside a partly shown electrolyzer, with the tapping tube in the tapping position.
Figure 2:
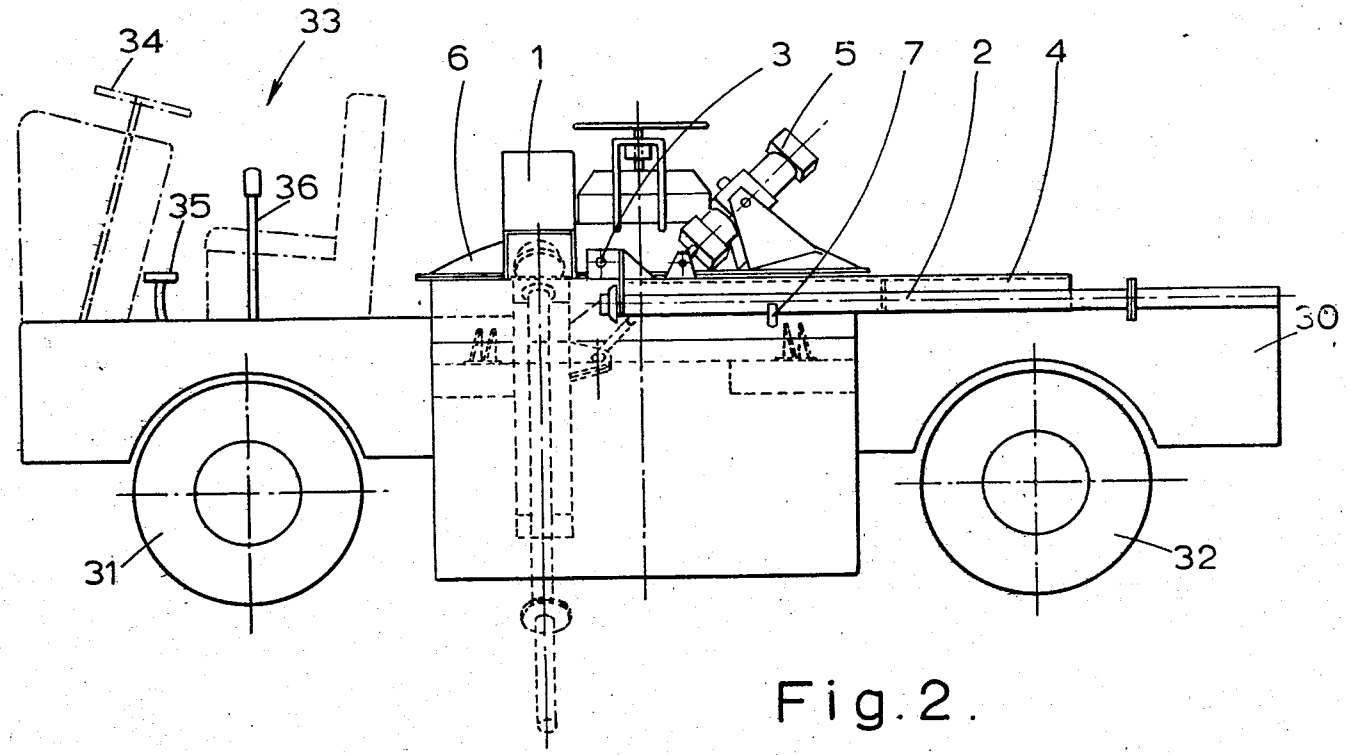
FIG. 2 is a side view of the tapping carriage of FIG. 1 with the tapping tube in the rest position and showing with dotted lines the tapping tube in the tapping position.

The carriage in FIGS. 1 and 2 comprises a frame 30 with front wheels 31 and rear wheels 32 and an operator seat 33. At the operator seat there are provided necessary operating members, such as a steering wheel 34, a pedal 35 for controlling the driving velocity forwardly and backwardly, respectively, and a handle 36 for controlling the movement of the tapping tube. Obviously, these operating members are shown only schematically, and the operator seat or compartment can comprise members or controls of other types and additional controls which can be used for certain operations in connection with the driving of the carriage and the performing of the tapping process or for other purposes.

Between the wheels 31 and 32 the frame 30 carries a crucible 6 which is provided with a domed cover on which various means for the tapping and discharging of metal melt are located.

The most important structures on the crucible are the tapping tube 2, an ejector device 8 for use when sucking metal melt through the tapping tube 2, a discharge tube (not shown) for delivering collected metal from the crucible 6, and compressed air means 9 which can for instance be in the form of a compressed air conduit for supplying compressed air, for discharging collected metal through the discharge tube.

Figure 3:
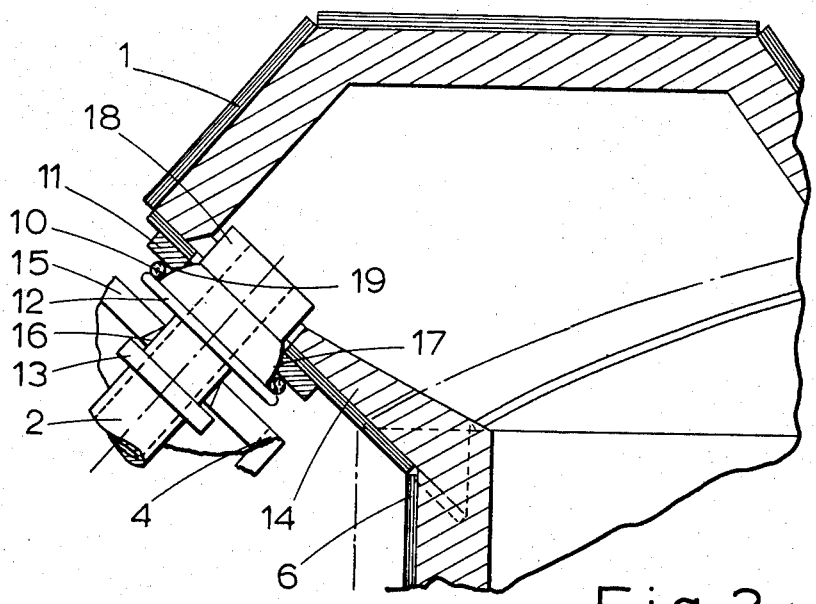
FIG. 3 is an enlarged vertical section of a tapping head on the crucible of the carriage and the upper part of the tapping tube.
Figure 4:
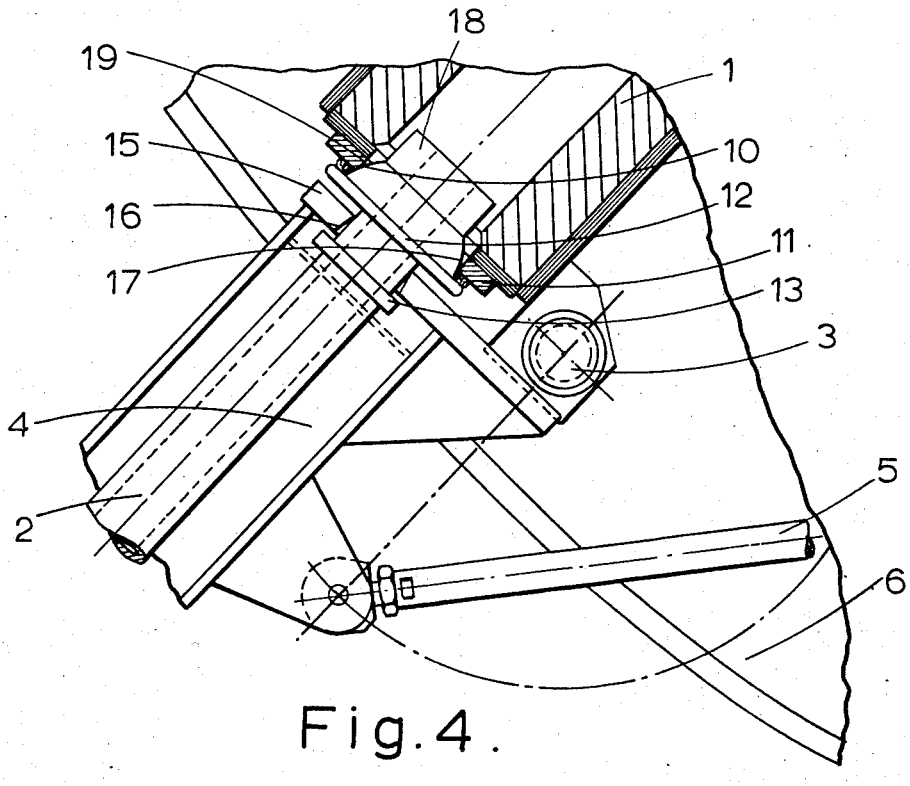
FIG. 4 is a horizontal section of part of the tapping head of FIG. 3 and the upper part of the tapping tube.

The tapping tube 2 is adapted to cooperate with a tapping head 1 which together with the upper part of the tapping tube 2 is shown in more detail in FIGS. 3 and 4. The tapping tube 2 is journalled on a pivot 3 in such a way that the tapping tube can be pivoted in a plane parallel to the longitudinal axis of the carriage and extending at an inclination downwardly and outwardly to the side of the carriage, as shown in particular in FIG. 1 in which the tapping tube is shown in the tapping position with its lower end immersed into the molten metal in the electrolyzer 40 which is shown only in part. The plane in which the pivoting movement of the tapping tube in principle takes place, extends through the tapping head 1, more closely through a tapping opening 19 therein. As shown in particular in FIG. 4, the pivot 3 of the tapping tube is located adjacent the tapping opening 19 and generally in the same plane as the latter. When the axis of the tapping tube forms an exact right angle to the pivot 3, the pivoting movement of the tapping tube 2 will take place exactly in the inclined plane mentioned above. It is evident, however, that small deviations from this plane can be present without substantially changing the function. With small angular deviations with respect to the right angle between the axis of the tapping tube and the pivot, the movement will take place in a conical surface with a very large opening angle. There may be cases in which deviations from the theoretical plane movement involve advantages. It is also evident that the movement pattern described here can be brought about also by means of other structures than with a single pivot located adjacent the tapping opening as shown in the drawing. For instance the tapping tube may be supported by a group of arms giving the tapping tube a pivoting movement substantially in the inclined plane discussed above.

The movement of the tapping tube 2 is caused by a a pneumatic cylinder 5 the piston rod of which is pivotably connected to a support 4 for the tapping tube at a distance below the upper end thereof. The supply of pressurized air to one or the other end of the cylinder 5 can be under control by means of the handle 36 at the operator seat 33 on the carriage. With the piston rod fully retracted into the cylinder 5 the tapping tube 2 with its support 4 will assume a rest position generally horizontally on the carriage adjacent the crucible as shown in FIG. 2. In this rest position the unit formed by the support 4 and the tapping tube 2 can be retained or locked by means of a stop 7.

Details of the particular structure of the tapping head 1 and the upper end of the tapping tube 2 and its support 4 will appear from FIGS. 3 and 4. The tapping opening 19 in the tapping head 1 is surrounded by a seat flange 11 adapted to cooperate with the upper end of the tapping tube 2 when this tube is pivoted down to its tapping position. The upper end of the tapping tube is formed with a spherical portion 17 the smallest diameter of which is smaller than, and the largest diameter of which is larger than the diameter of the tapping opening 19 in the seat flange 11. Since the spherical portion 17 is under the influence of the reduced pressure in the crucible during the sucking up of metal melt, it is pressed against the seat flange 11. It is advantageous that the spherical portion 17 be made of a harder material than the seat flange 11, as it will be easier and cheaper to replace flange 11 upon wear.

Inwardly of the spherical portion 17 the tapping tube is provided with a flange 12 serving to give an additional sealing effect against the seat flange 11 through the intermediary of a cord-like asbestos packing 10 which is tightly compressed between these flanges when suction is applied. It will be understood that before the suction starts, the upper end of the tapping tube at the termination of the pivoting movement to the tapping position will be brought into engagement with the tapping head 1, whereafter the suction additionally contributes to and strengthens the compression between the above sealing members so that a sufficient sealing is obtained.

To avoid splashing of molten metal which may damage the different parts of the sealing arrangement as described above, the upper end of the tapping tube 2 is provided with an extension 18 adapted to extend such a distance into the tapping head 1 that possible drops of liquid metal will be led into the crucible away from the outer part of the tapping head. As an additional contribution thereto the tapping head 1 is provided with a lining in the form of an inwardly and downwardly inclined floor 14 preventing metal during the terminating phase of the tapping from collecting at undesired places in the tapping head.

As already mentioned above, the tapping tube 2 is placed in a cradle-like support 4 which surrounds the tapping tube approximately from the upper end thereof and along a substantial portion of the length of the tube towards the other end. The support 4 has various purposes, including primarily that of supporting the tapping tube in order that it can be replaced quickly and easily and in order that the tapping tube will be able to undergo small movements both radially and axially in relation to the support. This latter feature is important to avoid damages or accidents if the tapping tube inadvertently touches parts of the electrolyzer, the crust or the like, which will often occur in practice. Due consideration to factors such as large temperature differences, heat expansion, etc., should also be considered in this connection. For securing and supporting of the tapping tube 2, the support 4 is — in addition to the longitudinal main parts forming bottom and side walls thereof — at the upper end provided with a retainer plate 15 with a recess or a hole 16 for the tapping tube. The recess 16 is conical so as to facilitate the free movement of the tapping tube. On the other hand the tapping tube is provided with a retainer flange 13 which together with the sealing flange 12 restricts the axial freedom of movement of the tapping tube with respect to the retainer plate 15 at the end of the support 4.

Figure 5:
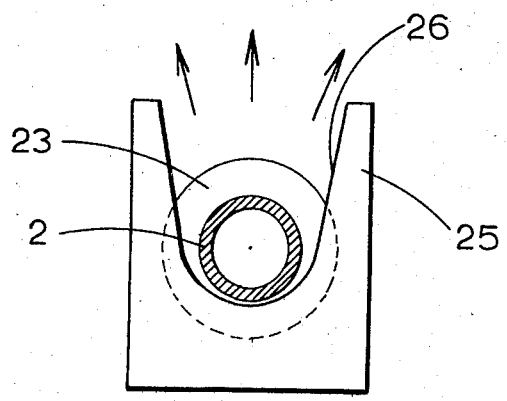
FIG. 5 is an enlarged an end view of embodiment of a support for the tapping tube.

Normally, the tapping tube will have at least two supporting areas in the support 4, i.e. at least one retainer plate or the like in addition to the retainer plate 15. FIG. 5 shows how such an additional retainer plate 25 can be formed with a cradle-like recess 26, widening upwardly so that the tapping tube 2 has freedom of movement upwardly and somewhat at an inclination laterally. Plate 25 is arranged with the above discussed necessary clearance, at the same time as replacement of the tapping tube 2 is comfortable. As shown in FIG. 5, the tapping tube 2 can have one or more additional retainer plates, for instance the plate 25 which must not be located so near to the connecting flange 23 on the tapping tube 2 that the axial movement thereof is prevented. The axial freedom of movement of the tapping tube 2 in the support 4 is also necessary in view of the terminating tight sucking of the upper end of the tapping tube so as to be engaged as air-tight as possible against the tapping head 1 during the tapping operation. It is evident, however, that the flanges described also serve to prevent the tapping tube from being inadvertently displaced too much in the support 4, in particular during acceleration and retardation when the tapping carriage is driven.

Obviously, the structures described by way of example with reference to the Figures of the drawings can be modified at many points without departing from the fundamental features of the invention, i.e. the specific pattern of movement associated with the tapping tube. Thus, the problems of sealing between the upper end of the tapping tube and the tapping head can be solved in other ways, although perhaps not with advantages described here. According to the specific circumstances, the tapping tube can also be supported otherwise than by means of a cradle-like support 4 as described here. Finally, there are possibilities for different arrangements of the main parts of the carriage with respect to each other, for instance by locating the operator compartment at the rear end of the carriage, whereby the operator will have the best field of view for driving the carriage and for controlling the movement of the tapping tube, respectively.

We claim:

1. A carriage for tapping molten metal from aluminum electrolyzers and the like, said carriage comprising:

a crucible having thereon a tapping head with a tapping opening therein;

a movable tapping tube adapted to be inserted downwardly into a metal melt from which tapping is to take place;

ejector means for sucking molten metal through said tapping tube into said crucible;

a discharge tube for delivering collected metal from said crucible;

said tapping tube being pivotably mounted substantially in an inclined plane which is parallel to the longitudinal axis of the carriage and which extends downwardly and outwardly to the side of the carriage from said tapping opening and said tapping head;

the upper end of said tapping tube being coupled in said tapping opening when said tapping tube is in the tapping position; and control means under control from an operator compartment on the carriage for moving said tapping tube within said plane, whereby the lower end of said tapping tube can be directed downwardly into a metal melt of an electrolyzer at the same time as the carriage is driven to a correct position at the electrolyzer for the tapping thereof.

2. A carriage as claimed in claim 1, wherein said tapping tube is pivotable about a pivot mounted at a right angle to said inclined plane and located adjacent said tapping opening.

3. A carriage as claimed in claim 1, wherein said upper end of said tapping tube is adapted to be pressed tightly against said tapping opening at the termination of pivoting movement of said tapping tube downwardly to the tapping position.

4. A carriage as claimed in claim 1, wherein said tapping tube is supported in a cradle-like support, with a clearance therebetween for relative movement of said tapping tube both radially and axially with respect to said support.

5. A carriage as claimed in claim 1, wherein said upper end of said tapping tube which is adapted to be in engagement with said tapping opening has a portion with a spherical shape made of a harder material than a seat flange surrounding said tapping opening and cooperating with said spherical portion.

6. A carriage as claimed in claim 5, wherein said upper end of said tapping tube has an extension inwardly of said spherical portion, said extension extending into said tapping head to prevent liquid metal from coming in direct contact with the cooperating sealing surfaces of said tapping tube and said tapping head.

7. A carriage as claimed in claim 5, wherein said upper end of said tapping tube below said spherical portion is provided with a sealing flange having thereon a loose asbestos packing adapted to sealingly contact said sealing flange, said spherical portion and said seat flange when said ejector means is actuated for sucking up metal into said crucible.

8. A carriage as claimed in claim 1, wherein said tapping tube is movable to a substantially horizontal rest position on the carriage.

9. A carriage as claimed in claim 4, wherein said tapping tube has at least one retainer flange adapted to cooperate with said support to prevent inadvertent displacement of said tapping tube in relation to said support.

10. A carriage as claimed in claim 4, wherein said support has therein at least two retainer flanges, at least one of which has a recess the profile of which has an increasing width upwardly from a substantially rounded bottom.

11. A carriage as claimed in claim 10, wherein said recess is conical to facilitate free movement of said tapping tube.

12. A carriage as claimed in claim 1, wherein said tapping head has an inner inclined refractory floor for collecting and directing metal drops from said upper end of said tapping tube down into the main part of said crucible.

* * * * *